US008376641B2

(12) United States Patent
Fraillon

(10) Patent No.: US 8,376,641 B2
(45) Date of Patent: Feb. 19, 2013

(54) APPLICATOR

(75) Inventor: Patrick Fraillon, Mamaroneck, NY (US)

(73) Assignee: Albea Services, Gennevilliers (FR)

( * ) Notice: Subject to any disclaimer, the term of this patent is extended or adjusted under 35 U.S.C. 154(b) by 1077 days.

(21) Appl. No.: 11/749,335

(22) Filed: May 16, 2007

(65) Prior Publication Data

US 2008/0286032 A1 Nov. 20, 2008

(51) Int. Cl.
*B43K 27/02* (2006.01)

(52) U.S. Cl. ..... 401/29; 401/19; 401/77

(58) Field of Classification Search ..... 401/11, 401/19, 29–35, 75–78
See application file for complete search history.

(56) References Cited

U.S. PATENT DOCUMENTS

| | | | | |
|---|---|---|---|---|
| 2,129,051 | A | 9/1938 | Eastley | |
| 2,591,027 | A * | 4/1952 | Turnes | 401/19 |
| 3,192,933 | A * | 7/1965 | Prince | 401/35 |
| 3,336,909 | A * | 8/1967 | Diamond | 401/259 |
| 5,026,189 | A * | 6/1991 | Keil | 401/29 |
| 6,293,720 | B1 | 9/2001 | Zahn | |
| 2005/0100388 | A1 | 5/2005 | Bedhome et al. | |

FOREIGN PATENT DOCUMENTS

| | | | |
|---|---|---|---|
| DE | 10011244 | A1 | 9/2001 |
| DE | 3835679 | A1 | 9/2008 |
| EP | 0954996 | A2 | 11/1999 |
| WO | 0165966 | A1 | 9/2001 |

* cited by examiner

*Primary Examiner* — David Walczak
(74) *Attorney, Agent, or Firm* — Banner & Witcoff, Ltd.

(57) ABSTRACT

An applicator for applying a medium, such as for eye make-up.

36 Claims, 2 Drawing Sheets

APPLICATOR

FIELD OF THE INVENTION

The invention is directed to an applicator. In particular, the invention is directed to an applicator for cosmetics, and particularly for eye make-up.

BACKGROUND OF THE INVENTION

Eye make-up is one of many cosmetics widely used by professional makeup artists and regular consumers alike. However, application of eye make-up is considered quite a difficult task, especially for those individuals who are inexperienced or have difficulty manipulating the applicator and shades for eye shadow. In particular, for many, application of cosmetics near the eye causes great stress. When one is applying eye make-up to one's own eyes, the stress level can make appropriate application difficult.

Users often struggle to achieve the proper proportions when applying eye make-up. For example, eye shadow often is applied more heavily in some areas and feathered, or smudged, at other areas to produce a desired effect. Often, the applicator is at one end of a tubular applicator, and the smudger is at the other end. Separate tools for applying and smudging also are available. Therefore, multiple tools may be used to properly apply eye shadow. Alternatively, a tool must be turned end-for-end to complete the application of eye shadow.

Having to deal with multiple tools or turning a single tool end-for-end causes complications. For example, in manipulating the tools, there exists the danger that the material being applied accidentally will be introduced into the eye or inadvertently is applied to other objects, such as the user's clothing or the wrong part of the body. The same danger exists for a tool that must be turned end for end to achieve the desired effect.

In certain circumstances, it may be desirable to be able to apply two shades of eye make-up simultaneously or serially. To do so requires manipulation of two applicators in addition to at least one smudger. The need to skillfully manipulate a plurality of tools makes it more difficult to obtain the desired effect.

Thus, there exists a need for an applicator that can serve to smudge eye make-up applied from the applicator without having to turn the applicator end for end. Similarly, there exists a need for an applicator wherein the applicator element or the smudger is axially movable relative to the other.

BRIEF SUMMARY OF THE INVENTION

A first embodiment is directed to an applicator having an applicator element and an exterior element at the same end of the tool.

A second embodiment is directed to an applicator having a smudging element exterior of the applicator element.

A third embodiment is directed to an applicator wherein at least one of the elements moves axially relative to the other.

DETAILED DESCRIPTION OF THE INVENTION

The invention is directed to an applicator. In one embodiment, the applicator is an applicator or cosmetic, particularly for eye make-up. In particular, an embodiment of the invention is directed to an applicator having an inner element by which a medium is applied and an outer coaxial element surrounding the inner element. In one embodiment, the outer element is a smudger for partially removing and redistributing applied medium. In one embodiment, the outer element is a second medium for application.

The material to be applied from the inner application element often is a cosmetic, such as eye make-up, eye shadow, and other compositions, such as blush or some forms of foundation. Typically, the inner application element comprises a consumable composition, and the inner application element becomes shorter as the applied material is used. However, the applied material can be liquid, with the first tip comprising a felt or other suitable applicator for liquid. Whatever the composition, the material is applied to the body in a manner typical for the material being applied. For example, eye shadow is applied by placing the applied composition directly on the eyelid and, for example, drawing the composition across the eyelid. Thus, in embodiments of the invention, the first tip is applied to the eyelid and then moved across the eyelid to apply the material. Then, material may be selectively removed or redistributed with a smudger. The skilled practitioner recognizes how to use the applicators described herein.

Figure 1:
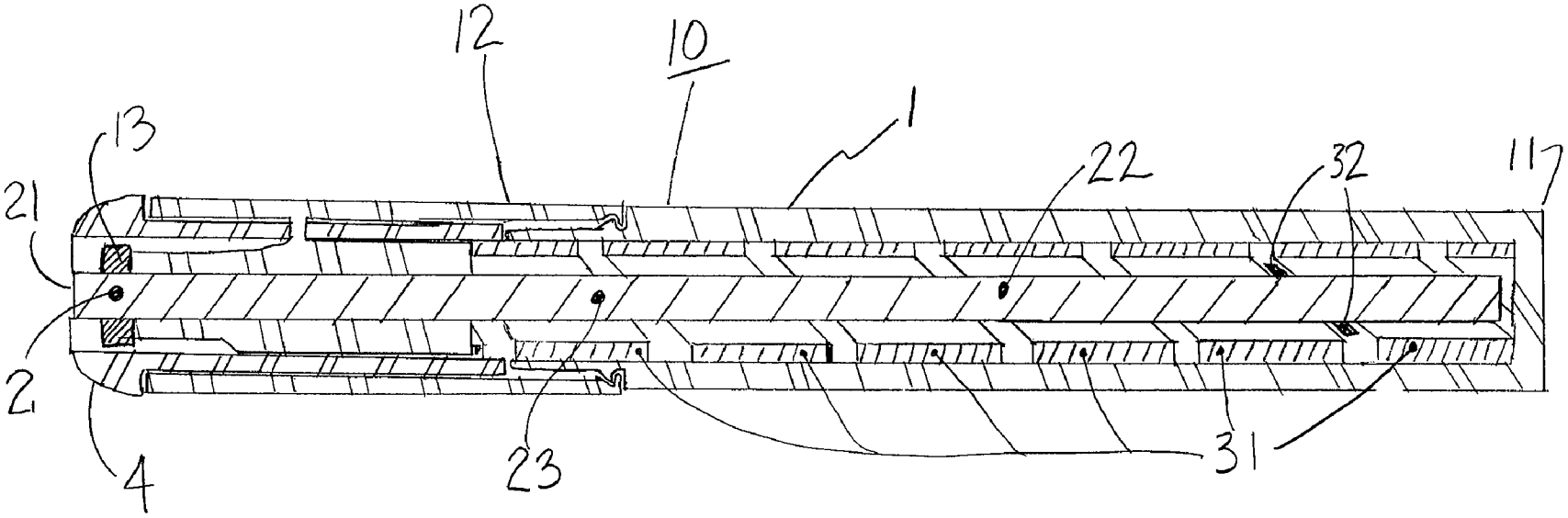
FIG. 1 illustrates a cross-sectional view of an embodiment of the applicator of the invention in which both elements move axially relative to each other.

In one embodiment, as illustrated in FIG. 1, applicator 10 includes outer barrel 1 having proximal end 11 and open distal end 12. The ends are attached so that they can rotate relative to each other, with one such type of attachment illustrated in FIG. 1. Skilled practitioners can, with the guidance provided herein, suitably attach the ends to each other.

Inner application element 2 is positioned coaxially within barrel 1. The inner application element is mounted coaxially within the outer barrel. The inner application element includes a first tip 21 at the distal end of the applicator and a reservoir 22 for medium to be applied with the first tip. The reservoir is operatively attached to the first tip. For example, if the medium is fluid, the operative attachment could be a tube conducting the medium from the reservoir to the first tip. If the inner application element is consumed, i.e., becomes shorter, during use, the operative attachment is the continuous medium 23 between the first tip and the reservoir. With the guidance provided herein, skilled practitioners recognize how to make this operative connection.

At least the first tip of the inner application element can be extended through the open distal end of the outer barrel. The inner application element can be fixedly mounted with the first tip of the inner application element extended through the open distal end of the barrel. In another embodiment, the inner application element can be mounted so that it can be moved axially relative to the barrel as shown in FIG. 1. In this embodiment, the first tip can be extended through the open distal end of the barrel and withdrawn to be entirely within the barrel. This embodiment is particularly convenient, as no cap is necessary. An inner application element that is consumed, i.e., becomes shorter, during use can be mounted either fixedly or axially moveable. However, moveable mounting affords the opportunity to deliver more material to be applied simply by advancing the inner application element.

Figure 2:
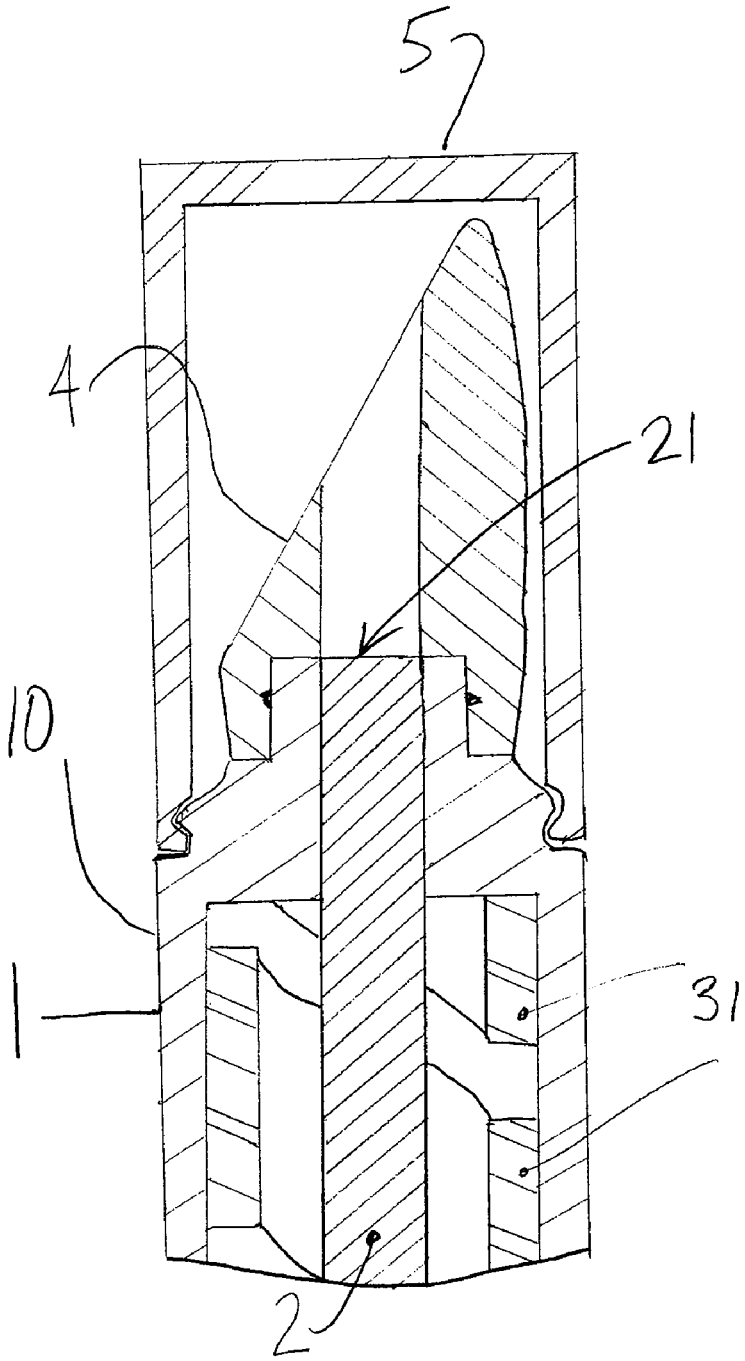
FIG. 2 illustrates a cross-sectional view of an embodiment of the distal end of the applicator of the invention in which only the interior element moves.

Any suitable manner of mounting the inner application element can be used. For example, various axial movement apparatus are known to the skilled practitioner. One example of such an apparatus includes a screw-type, or helical, apparatus, as shown in FIG. 1. A similar helix mechanism is illustrated in FIG. 2 and described below. In the apparatus of FIG. 1, a helix 31 is fixed in the proximal portion of the outer barrel and an index tab or screw 32 is fixed to the inner application element and mounted to cooperate with the helix so that the tab or screw, and therefore the inner application element, moves axially within the barrel. To ensure that the inner application element moves axially when the barrel is rotated, and does not merely rotate with the outer barrel, outer barrel 1 can be divided into proximal end 11 and open distal end 12. Inner application element 2 is precluded from rotating by collar 13 attached to the distal portion of the outer barrel. Inner application element 2 thus can rotate with regard to the proximal end of the outer barrel. The collar precludes rotational motion but allows the inner application element to slide axially through the collar when the barrel ends are rotated relative to each other. The rotation causes the screw, and therefore the inner application element, to move axially within the barrel.

Other methods for movably and fixedly mounting the inner application element within the barrel. For example, the helix could be attached to a rotatable distal end. Indeed, any manner of ensuring relative motion of the helix and the barrel is satisfactory. The skilled practitioner can, with the guidance provided herein, determine how to mount the inner application element.

Outer element 4 is attached to the distal portion of the barrel. In one embodiment, the outer element is fixedly attached to the distal portion of the barrel. In another embodiment and as illustrated in FIG. 1, outer element 4 is slidably attached to distal portion 12 of the barrel so that the outer element is slidable axially. In another embodiment, the outer element is rotatably attached to the distal portion of the barrel. In yet another embodiment, the outer element is both rotatably and slidably attached to the distal portion of the barrel. The outer element surrounds the opening in the distal end of the barrel and at least the first tip of the inner application element.

In one embodiment, the outer element comprises a smudger, or a composition used to redistribute and perhaps remove some of the material applied. Skilled practitioners recognize that smudgers can be made from various materials, including sponge material, felt material, woven and non-woven fabrics, and similar compositions. With the guidance provided herein, the skilled practitioner will be able to select a composition from which a smudger can be formed.

In another embodiment, the outer element comprises a material to be applied simultaneously with or conveniently after application of the material of the inner application element. The composition of this outer-element material would be similar to the applied material from an inner application element that is consumed when used. The material of the outer element could be applied to accent or complement the applied material from the inner application element.

In another embodiment of applicator 10, as illustrated in FIG. 2, applicator 10 includes outer barrel 1 having a proximal end (not shown) and open distal end 12. The ends need not rotate with respect to each other and the outer barrel can be one piece. Inner application element 2 is positioned coaxially within barrel 1. The inner application element includes a first tip 21 at the distal end of the applicator and a reservoir (not shown) for medium to be applied with the first tip. The reservoir is operatively attached to the first tip, as described above. In this embodiment, the inner application element is movably attached to the outer barrel utilizing helix 31 attached to a cap at the proximal end and a tang (not shown) attached to inner application element 2, also as described above, to enable axial movement of the inner application element in the barrel. When the inner application element is moved axially toward distal end 12, it protrudes through outer element 4 and becomes available for application.

Outer element 4 is fixedly mounted surrounding the opening in distal end 12 of the outer barrel. The first tip 21 protrudes through the outer element for application by the user. The outer element is immediately available for use, whether as a smudger or as a second material applied simultaneously.

A cap 5 can be releasably attached to distal end 12 to keep the tips clean and to keep the applied material from marking other objects. The cap is releasably attached to the distal end of the outer barrel in any suitable manner, such as by snapping on, as illustrated in FIG. 2.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

The invention claimed is:

1. A cosmetic applicator having a longitudinal axis, a distal end, and a proximal end, said applicator comprising an outer barrel having a proximal end and an open distal end at the distal end of the applicator;

an inner application element positioned coaxially within the barrel and having a first tip at the distal end of the applicator for applying a medium and a reservoir for the medium operatively connected to the first tip;

an outer element coaxial with the inner element and the outer barrel and having a second tip at the distal end of the applicator, the second tip coaxial with and surrounding the first tip; and a collar positioned between the outer element and the inner element;

wherein the collar separates the outer element from the inner element;

wherein at least one of the inner and outer elements can be moved axially relative to the other; and wherein the collar precludes rotational motion but allows the inner application element to slide axially through the collar when the barrel ends are rotated relative to each other.

2. The applicator of claim 1 wherein the inner application element is movable axially relative to the outer element.

3. The applicator of claim 2 wherein the outer element is movable axially relative to the inner element.

4. The applicator of claim 3 wherein the outer element is slidably movable.

5. The applicator of claim 1 wherein the first tip comprises an applicator for a cosmetic.

6. The applicator of claim 5 wherein the applicator is adapted to apply a consumable eye shadow.

7. The applicator of claim 5 wherein the outer element comprises cosmetic.

8. The applicator of claim 1 wherein the first tip comprises a cosmetic.

9. The applicator of claim 8 wherein the cosmetic is eye shadow.

10. The applicator of claim 8 wherein the inner application element is consumable.

11. The applicator of claim 10 wherein the cosmetic is eye shadow.

12. The applicator of claim 1 wherein the outer element is movable axially relative to the inner element.

13. The applicator of claim 12 wherein the outer element is slidably movable.

14. The applicator of claim 1 wherein the outer element comprises a cosmetic composition adapted for redistributing or removing the medium applied by the inner application element.

15. The applicator of claim 14, wherein the smudger comprises sponge material, felt material, woven fabric, or_non-woven fabric.

16. The applicator of claim 1 wherein the first tip can be extended through the open distal end of the outer barrel.

17. The applicator of claim 16 wherein the outer element is movable axially relative to the inner element.

18. The applicator of claim 17 wherein the outer element comprises a cosmetic smudger.

19. The applicator of claim 17 wherein the first tip comprises a cosmetic.

20. The applicator of claim 19 wherein the outer element comprises a cosmetic smudger.

21. The applicator of claim 19 wherein the outer element comprises cosmetic.

22. The applicator of claim 1, wherein the inner element comprises a first medium for application and the outer element comprises a second medium for application.

23. The applicator of claim 1, wherein the operative connection between the first tip and the reservoir of the inner element is a continuous medium.

24. The applicator of claim 23, wherein the medium is consumed by use.

25. A cosmetic applicator having a longitudinal axis, a distal end, and a proximal end, said applicator comprising an outer barrel having a proximal end and an open distal end at the distal end of the applicator;

an inner application element positioned coaxially within the barrel and having a first tip at the distal end of the applicator for applying a medium and a reservoir for the medium operatively connected to the first tip;

an outer element coaxial with the inner element and the outer barrel and having a second tip at the distal end of the applicator, the second tip coaxial with and surrounding the first tip; and a collar positioned between the outer element and the inner element, wherein the collar separates the outer element from the inner element;

wherein the outer element comprises a cosmetic smudger, wherein the smudger comprises sponge material, felt material, woven fabric, or non-woven fabric;

wherein at least one of the inner and outer elements can be moved axially relative to the other; and wherein the collar precludes rotational motion but allows the inner application element to slide axially through the collar when the barrel ends are rotated relative to each other.

26. The applicator of claim 25 wherein the outer element is fixedly attached to the distal end of the barrel.

27. The applicator of claim 25 wherein the cosmetic applicator comprises a helix fixed to the proximal end of the outer barrel and an index tab or screw fixed to the inner application element and mounted to cooperate with the helix so that the inner application element moves axially within the barrel.

28. The applicator of claim 25 wherein the inner application element is movable axially relative to the outer element.

29. The applicator of claim 25 wherein the first tip comprises an applicator for a cosmetic.

30. The applicator of claim 25 wherein the first tip comprises a cosmetic.

31. The applicator of claim 30 wherein the inner application element is consumable.

32. The applicator of claim 25 wherein the first tip can be extended through the open distal end of the outer barrel.

33. The applicator of claim 25 wherein the outer element is slidably movable.

34. The applicator of claim 25 wherein the operative connection between the first tip and the reservoir of the inner element is a continuous medium.

35. The applicator of claim 1 wherein the outer element is fixedly attached to the distal end of the barrel.

36. The applicator of claim 1 wherein the cosmetic applicator comprises a helix fixed to the proximal end of the outer barrel and an index tab or screw fixed to the inner application element and mounted to cooperate with the helix so that the inner application element moves axially within the barrel.

* * * * *